US007086479B2

(12) United States Patent
Schultz et al.

(10) Patent No.: US 7,086,479 B2
(45) Date of Patent: Aug. 8, 2006

(54) EXPANDING WELL TOOLS

(75) Inventors: Roger L. Schultz, Aubrey, TX (US); Syed Hamid, Dallas, TX (US); Harold Kent Beck, Lewisville, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/957,991

(22) Filed: Oct. 4, 2004

(65) Prior Publication Data

US 2005/0039916 A1 Feb. 24, 2005

Related U.S. Application Data

(62) Division of application No. 10/217,380, filed on Aug. 13, 2002, now Pat. No. 6,799,635.

(51) Int. Cl.
*E21B 23/00* (2006.01)
*E21B 23/06* (2006.01)

(52) U.S. Cl. ..... 166/381; 166/206; 166/316; 166/334.1

(58) Field of Classification Search ..... 166/381, 166/386, 387, 277, 118, 206, 207, 316, 334.1
See application file for complete search history.

(56) References Cited

U.S. PATENT DOCUMENTS

| | | | | |
|---|---|---|---|---|
| 2,583,316 | A | 1/1952 | Bannister | |
| 2,729,293 | A | 1/1956 | Cloud | |
| 2,993,540 | A | 7/1961 | Fons et al. | |
| 3,194,312 | A | 7/1965 | Thomas | |
| 3,669,190 | A | 6/1972 | Sizer et al. | |
| 3,776,307 | A | 12/1973 | Young | |
| 3,865,188 | A | 2/1975 | Doggett et al. | |
| 4,759,409 | A | 7/1988 | Gullion | |
| 5,775,429 | A | 7/1998 | Arizmendi et al. | |
| 6,050,341 | A * | 4/2000 | Metcalf | 166/383 |
| 6,085,838 | A | 7/2000 | Vercaemer et al. | |
| 6,457,532 | B1 * | 10/2002 | Simpson | 166/380 |
| 6,478,091 | B1 * | 11/2002 | Gano | 166/373 |
| 6,598,677 | B1 * | 7/2003 | Baugh et al. | 166/285 |
| 6,598,678 | B1 | 7/2003 | Simpson et al. | |
| 6,626,240 | B1 * | 9/2003 | Sunde | 166/196 |
| 6,691,789 | B1 * | 2/2004 | Jackson et al. | 166/384 |
| 6,834,725 | B1 * | 12/2004 | Whanger et al. | 166/384 |
| 6,877,567 | B1 * | 4/2005 | Hirth | 166/382 |
| 2002/0092654 | A1 | 7/2002 | Coronado et al. | |
| 2002/0107562 | A1 * | 8/2002 | Hart et al. | 623/1.15 |
| 2003/0042028 | A1 | 3/2003 | Lauritzen et al. | |
| 2003/0178204 | A1 | 9/2003 | Echols et al. | |
| 2005/0029812 | A1 * | 2/2005 | Metcalfe | 285/382 |
| 2005/0098324 | A1 * | 5/2005 | Gano | 166/384 |
| 2006/0027370 | A1 * | 2/2006 | Weinrich | 166/313 |

OTHER PUBLICATIONS

Haliburton Energy Services brochure entitled, "Multiple Stage Packer Cementing Collar (MSPCC),"undated.

* cited by examiner

*Primary Examiner*—David Bagnell
*Assistant Examiner*—Shane Bomar
(74) *Attorney, Agent, or Firm*—John W. Wustenberg; Konneker & Smith, P.C.

(57) ABSTRACT

Methods of expanding well tools, which permit operation of the well tools after expansion, are provided. In a described example, a cementing tool includes a valve and a packer. After the cementing tool is expanded, the valve is selectively opened and closed, and the packer is sealingly engaged in a wellbore.

71 Claims, 5 Drawing Sheets

EXPANDING WELL TOOLS

CROSS-REFERENCE TO RELATED APPLICATION

This application is a division of prior application Ser. No. 10/217,380 filed Aug. 13, 2002 now U.S. Pat. No. 6,799,635. The prior application is incorporated herein in its entirety by this reference.

BACKGROUND

The present invention relates generally to operations performed and equipment utilized in conjunction with a subterranean well and, in an example described herein, more particularly provides a well tool which is operational after being expanded in a well.

It is well known in the art of well drilling and completion to expand various well tools in cased or uncased wellbores. For example, a well screen may be conveyed into a wellbore as part of a casing, liner or tubing string, and then the screen may be expanded so that it provides support to the wellbore. A packer may be expanded so that it sealingly engages the wellbore.

However, some well tools include moving parts which must displace relative to one another in order for the well tool to operate. For example, valves used in wells typically include a sleeve or other type of closure member which must displace relative to a housing in order to open or close a port or other type of flow passage. Because the expansion process generally includes substantial deformation of the various components making up a well tool, as of yet there has been no satisfactory method developed for displacing one component relative to another after expansion of the well tool.

Therefore, it may be seen that it would be very desirable to provide such a method, so that a well tool may be operated after it is expanded in a well. It would be particularly advantageous if, even though the components are in direct contact with each other during the expansion process, some clearance is provided between the components after expansion, so that one may be readily displaced relative to the other. Such a method would permit, for example, operation of a valve or setting of a packer after being expanded in a well.

SUMMARY

In carrying out the principles of the present invention, in accordance with an example thereof, a method is provided which solves the above problems in the art, as well as achieving other substantial benefits. In the example provided, a cementing tool includes a valve and a packer, which are particularly suitable for staged cementing operations, and which are operable after being expanded in a well. However, the principles of the invention may be applied to any type of well tool or combination of tools.

In one aspect of the invention, a method of cementing a tubular string in a wellbore is provided. The method includes the steps of: interconnecting a cementing tool in the tubular string, the cementing tool including at least one port for selectively permitting cement flow therethrough; expanding the cementing tool in the wellbore; and then opening the port.

In another aspect of the invention, a method of sealing a tubular string within a wellbore is provided. The method includes the steps of: interconnecting a packer in the tubular string, the packer including a circumferentially extending seal; expanding the seal outward by circumferentially elongating the seal; and then compressing the seal longitudinally relative to the tubular string, thereby outwardly extending the seal.

In a further aspect of the invention, another method of cementing a tubular string in a wellbore is provided. The method includes the steps of: interconnecting a cementing tool in the tubular string, the cementing tool including a valve for selectively permitting cement flow between an interior of the tubular string and the wellbore external to the tubular string, and a packer for sealingly engaging between the cementing tool and the wellbore; radially outwardly expanding the cementing tool, thereby enlarging a flow passage formed through the valve and the packer; then opening the valve; and sealingly engaging the packer in the wellbore.

In a still further aspect of the invention, a method of expanding a well tool in a wellbore is provided. The method includes the steps of: providing the well tool having a first member at least partially overlying a second member; expanding the well tool by applying an outwardly directed force to the second member, thereby displacing the first and second members outward; and then operating the well tool by displacing the second member relative to the first member in a direction orthogonal to the outwardly directed force.

In an additional aspect of the invention, another method of expanding a well tool in a wellbore is provided. The method includes the steps of: providing the well tool having a first member at least partially overlying a second member; expanding the well tool, thereby enlarging a flow passage formed through the well tool; then producing a clearance between the first and second members; and then operating the well tool by causing relative displacement between the first and second members.

In yet another aspect of the invention, a method of expanding a valve in a wellbore is provided. The method includes the steps of: interconnecting the valve in a tubular string, the valve including at least one port for selectively permitting flow therethrough; expanding the valve in the wellbore; and then opening the port.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
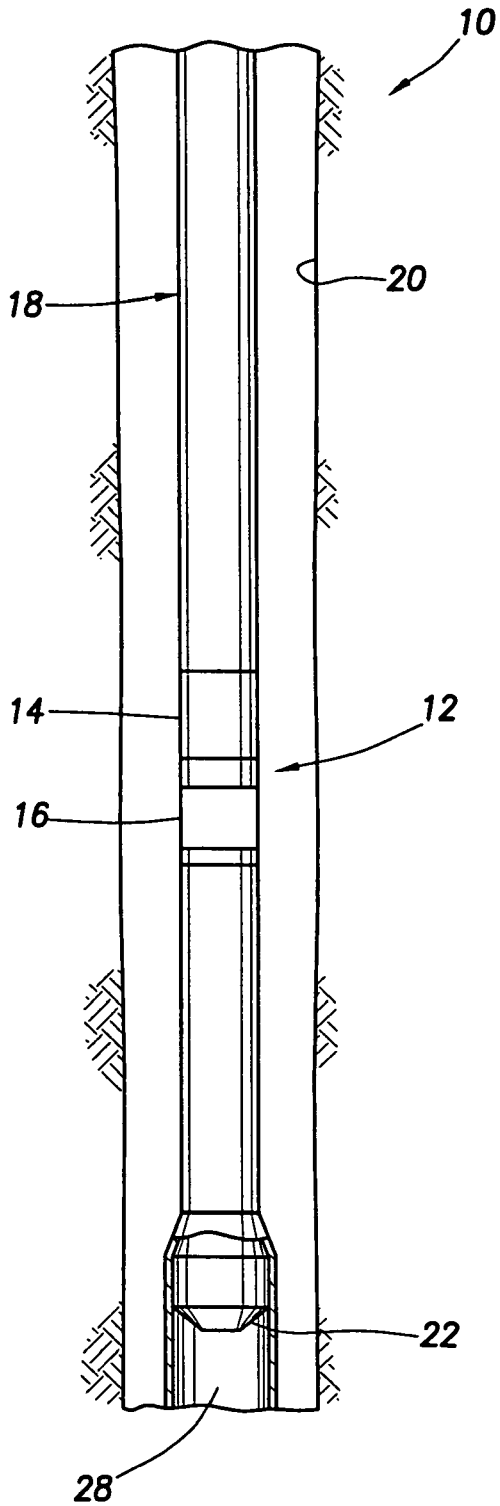
FIG. 1 is a schematic partially cross-sectional view of a cementing method embodying principles of the present invention.

Representatively illustrated in FIG. 1 is a method lo which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

The method 10 is described herein as an example of the principles of the invention. In the method 10, a cementing tool 12 which includes a valve 14 and a packer 16 is interconnected in a tubular casing or liner string 18 and conveyed into a wellbore 20. The cementing tool 12 is expanded, along with the remainder of the casing string 18, for example, by displacing a wedge or cone 22 through the casing string. After the expanding process, the valve 14 and packer 16 are operated in a staged cementing operation.

However, it is to be clearly understood that the method 10 is merely an example of one use of the principles of the invention. It is not necessary for the casing string 18 to be made up of casing. Any type of tubular string may be used, for example, a segmented or coiled tubing string. It is not necessary for the wellbore 20 to be uncased, since it could have been previously cased or otherwise lined. It is not necessary to displace the wedge 22 through the string 18 to expand the tool 12, since other means, such as an inflatable bladder, could be used to expand the tool. It is not necessary for the tool 12 to include a combination of other tools, such as the valve 14 and packer 16, since only a single tool or another combination of tools could be used. Therefore, it will be appreciated that no particular detail of the method 10 is essential in practicing the invention, rather the details of the method 10 described herein are provided to permit a person skilled in the art to practice the invention in a variety of different applications.

Figure 2:
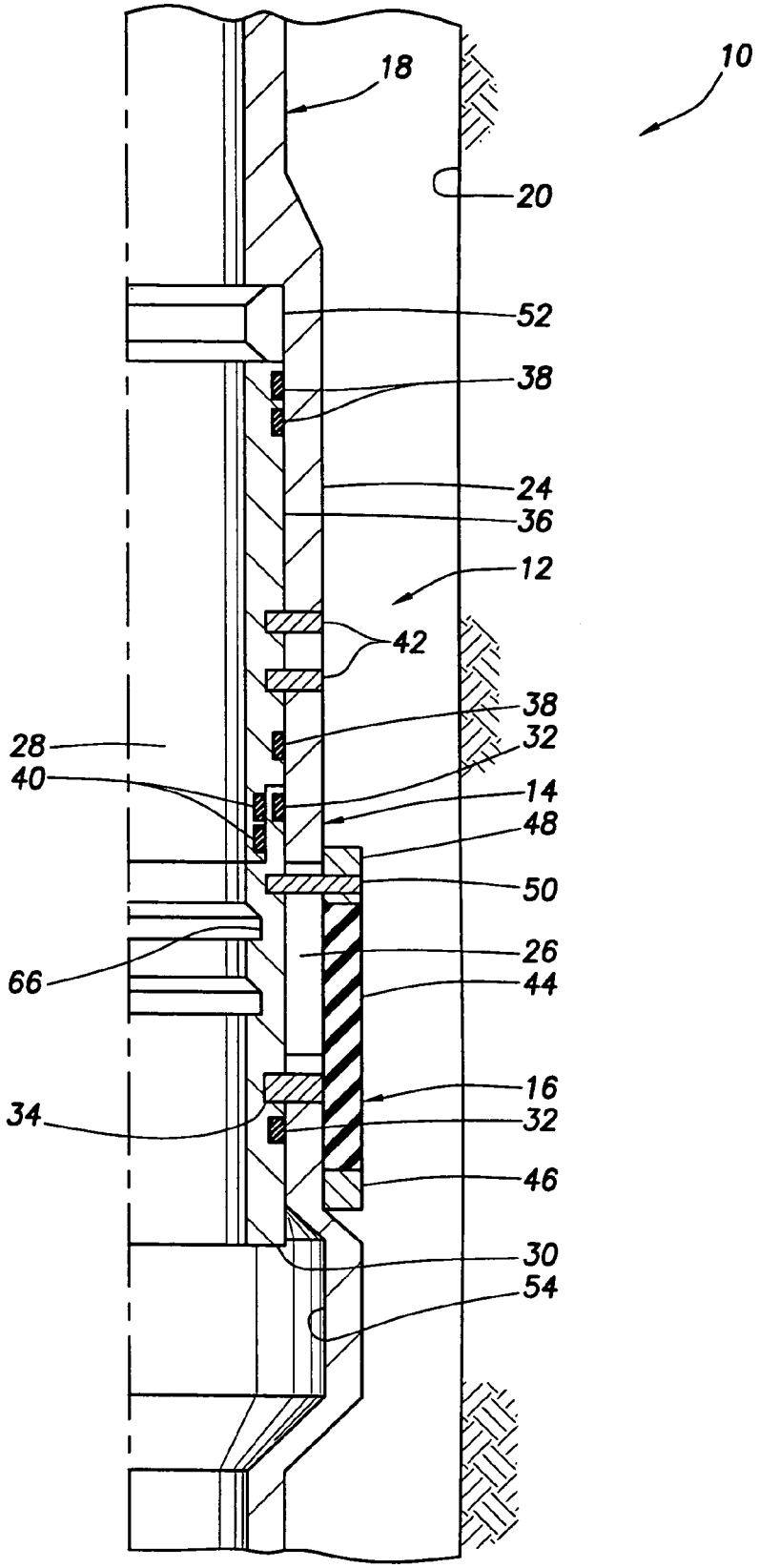
FIG. 2 is an enlarged scale schematic cross-sectional view through a staged cementing tool used in the method of FIG. 1, the tool embodying principles of the invention.

Referring additionally now to FIG. 2, an enlarged cross-sectional view of the tool 12 is representatively illustrated. The tool 12 is shown in the method 10 prior to being expanded. In this view it may be seen that the valve 14 and packer 16 include several components or members which overlap one another.

The valve 14 includes a generally tubular outer housing 24 having a port 26 formed through a sidewall thereof. The port 26 is for selectively permitting flow between an internal flow passage 28 of the tool 12 and the wellbore 20 external to the tool. The flow passage 28 also extends through the remainder of the string 18.

An inner generally tubular sleeve 30 initially blocks flow through the port 26. Seals 32 carried on the sleeve 30 prevent leakage between the sleeve and the interior of the housing 24. The sleeve 30 is releasably secured in this position by a shear pin 34.

Another generally tubular inner sleeve 36 is provided in the housing 24 for closing the port 26 after the port has been opened by displacing the other sleeve 30 downward relative to the housing. For convenience, the upper sleeve 36 may be referred to as the "closing" sleeve, and the lower sleeve 30 may be referred to as the "opening" sleeve.

Seals 38 are carried on the closing sleeve 36 for preventing leakage between the sleeve and the interior of the housing 24. Additional seals 40 are carried on a portion of the closing sleeve 36 which overlaps a portion of the opening sleeve 30. The seals 40 are for preventing leakage between the sleeves 30, 36. The closing sleeve 36 is releasable secured in this position by shear pins 42.

The packer 16 includes a generally tubular seal 44 carried externally on the housing 24. A lower end of the seal 44 is secured to a ring 46 attached to the housing 24, and an upper end of the seal is secured to a sleeve 48 reciprocably disposed on the housing. It will be appreciated that the seal 44 may be longitudinally compressed by displacing the sleeve 48 downward (as viewed in FIG. 2) relative to the housing 24.

The packer sleeve 48 is secured to the opening sleeve 30 of the valve 14 by a pin 50 extending through the port 26. Thus, when the opening sleeve 30 is displaced downward to open the valve 14 (as described more fully below), the packer sleeve 48 is also displaced downward, thereby longitudinally compressing the seal 44.

A generally C-shaped snap ring 52 is positioned in the housing 24 above the closing sleeve 36. The snap ring 52 is used in displacing the closing sleeve 36 downward when it is desired to prevent flow through the port 26. At this point, however, note that the snap ring 52 does not obstruct the flow passage 28 when the tool 12 is in its unexpanded configuration as depicted in FIG. 2.

An enlarged bore 54 is formed in the housing 24 below the opening sleeve 30. This bore 54 is useful after the tool 12 is expanded, so that the opening sleeve 30 may be displaced downward relative to the housing, the bore being larger than the sleeve after the sleeve is expanded.

Figure 3:
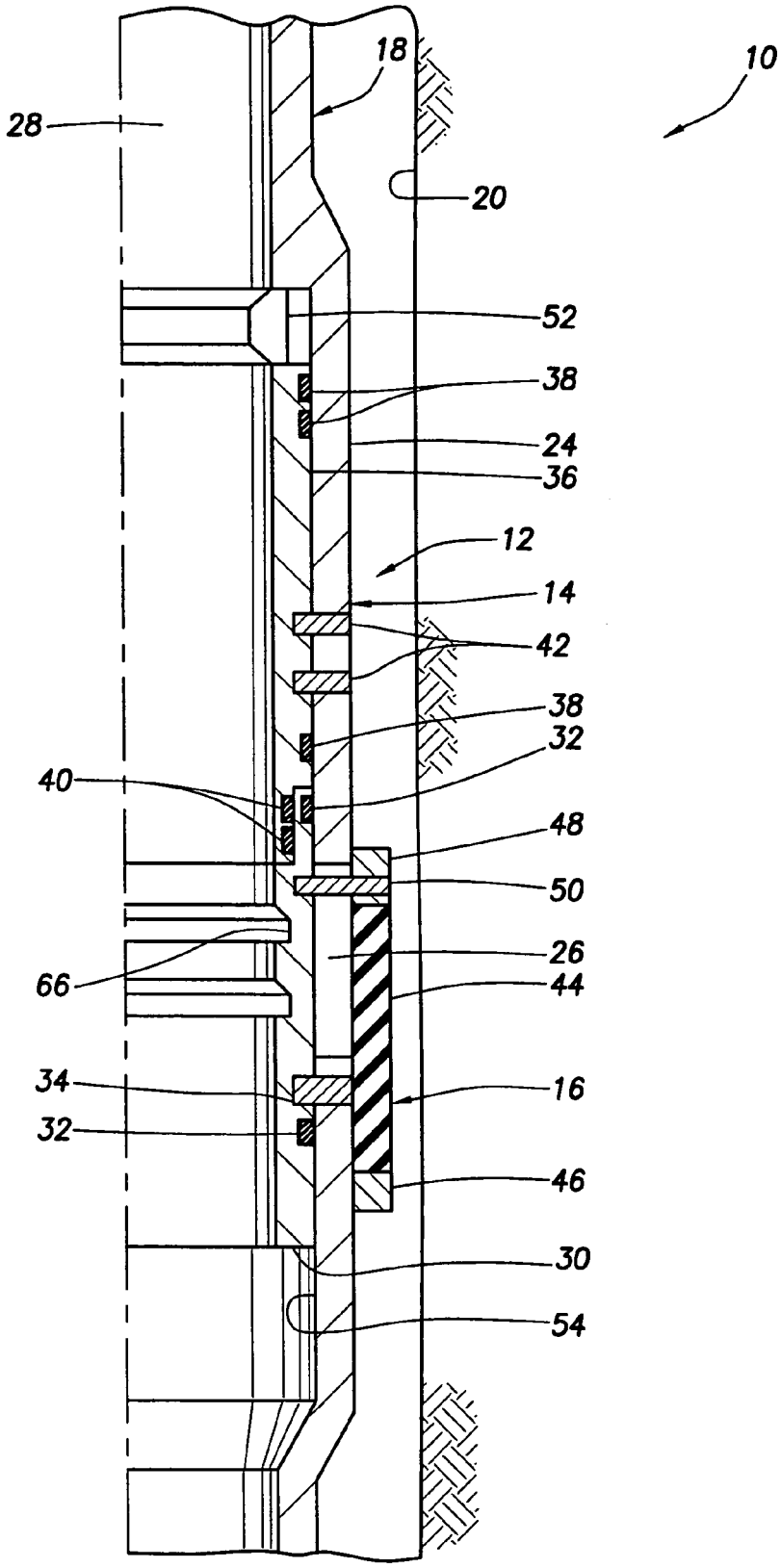
FIG. 3 is a cross-sectional view of the cementing tool in an expanded configuration.

Referring additionally now to FIG. 3, the cementing tool 12 is representatively illustrated in its expanded configuration. As described above, the tool 12 and the remainder of the casing string 18 may be expanded by using a variety of techniques, such as by displacing the wedge 22 therethrough, inflating a bladder therein, etc.

The seal 44 of the packer 16 has been circumferentially elongated by the expansion process, but does not yet sealingly engage the wellbore 20 as depicted in FIG. 3. However, the seal 44 could sealingly engage the wellbore 20 at this point if desired, without longitudinally compressing the seal as described below.

The snap ring 52 returns to its unexpanded configuration after the expansion process. This is due to the fact that the snap ring 52 is not plastically deformed during the expansion process, but instead elastically expands by opening a gap in its C shape, and then radially retracts by closing the gap. The snap ring 52 now extends into the flow passage 28, which has been enlarged by the expansion process.

Note that the housing 24, the closing sleeve 36, the opening sleeve 30, the packer ring 46, seal 44 and sleeve 48 have all been expanded radially outward. Each of these members has been circumferentially elongated by the expansion process. If prior methods had been used, such expansion of overlapping tubular members would have rendered the valve 14 and packer 16 inoperative, due to interference between them produced by the expansion process. In contrast, the method 10 incorporating principles of the present invention permits clearance to be provided between the various expanded members after the expansion process, so that the members may be displaced relative to one another to operate the valve 14 and packer 16.

Although the clearance is imperceptible in FIG. 3 (in actual practice the clearance may be as small as a few thousandths of an inch), there is radial clearance between the closing sleeve 36 and the housing 24, between the opening sleeve 30 and the housing, between the opening and closing sleeves where they overlap, and between the housing and the packer sleeve 48. Each of these members has been both elastically and plastically deformed radially outward. The manner in which the method 10 provides for clearance between the members after such deformation is representatively illustrated in FIGS. 4 & 5.

Figure 4:
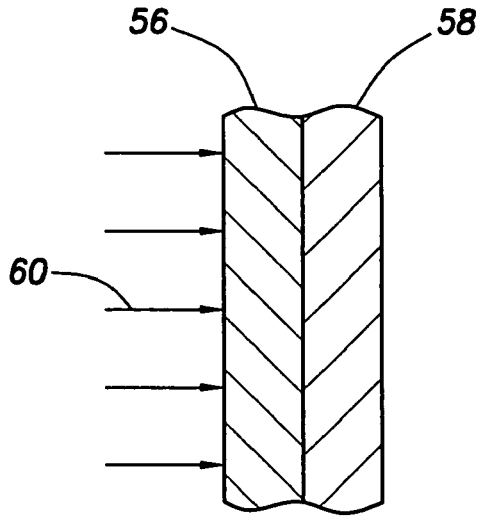
FIGS. 4 & 5 are schematic cross-sectional views of a method of expanding well tools embodying principles of the invention.

In FIG. 4 are depicted an inner member 56 and an outer member 58 during an expansion process. An outwardly directed biasing force (represented by arrows 60) is applied to the inner member 56, which is in direct contact with the outer member 58. The force 60 may be produced in the method 10 by the wedge 22 or other expansion device used to expand the casing string 18 radially outward.

At least a portion of the force 60 is transmitted from the inner member 56 to the outer member 58 due to this contact between the members. The force 50 outwardly deforms the inner and outer members 56, 58 to thereby expand the members.

For the members 56, 58 to remain expanded after the force 60 is removed, some plastic deformation of the members should occur during the expansion process. This plastic deformation occurs in each member 56, 58 after elastic deformation of that member. Thus, the expansion process preferably includes both elastic and plastic deformation of each of the members 56, 58.

After the force 60 is removed, a substantial portion of the elastic deformation of each of the members 56, 58 will be recovered, thereby retracting the members 56, 58 inward somewhat. The plastic deformation remains in the members 56, 58, so that they remain in an expanded configuration. The expanded configuration of the members 56, 58 is depicted in FIG. 5 after the force 60 has been removed.

Note that a clearance A now exists between the members 56, 58 in their expanded configuration, even though during the expansion process (as depicted in FIG. 4) the members were in direct contact with each other. This result is achieved by designing the members 56, 58 so that, during the expansion process, the inner member 56 has a greater outward elastic deformation than the outer member 58. In this manner, the inner member 56 will inwardly retract a greater distance to recover its elastic deformation than will the outer member 58 when the force 60 is removed. The clearance A is produced when the inner member 56 inwardly retracts a greater distance than does the outer member 58.

A variety of methods may be used to produce greater outward elastic deformation in the inner member 56 than in the outer member 58 during the expansion process. For example, the inner member 56 may be made of a material which has a different Young's modulus than a material of which the outer member 58 is made. The members 56, 58 may have different yield strengths. The members 56, 58 may be configured (e.g., having different thicknesses) to yield at different points in the expansion process. Any of numerous methods, and combinations of methods, may be used to provide greater outward elastic deformation in the inner member 56 as compared to that in the outer member 58.

Figure 5:
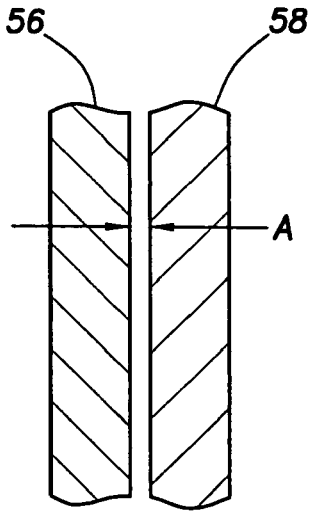

Because there is now clearance A between the members 56, 58 as depicted in FIG. 5, the members may be displaced relative to one another, without interference therebetween. For example, the inner member 56 may be displaced upward or downward, or the inner member may be rotated, relative to the outer member. In general, relative displacement of the inner and outer members 56, 58 in any direction orthogonal to the direction of the biasing force 60 is readily permitted by providing the clearance A between the members.

Applying these principles to the cementing tool 12 in the method 10, preferably the closing sleeve 36 has greater outward elastic deformation than the housing 24, the opening sleeve 30 has greater outward elastic deformation than the housing, the closing sleeve has greater outward elastic deformation than the opening sleeve, and the housing has greater outward elastic deformation than the packer sleeve 48, during the expansion process. In this manner, clearance will be provided between these respective overlapping members when the expansion force is removed and the members retract inward.

Of course, it is not necessary for plastic deformation to be produced in each of the overlapping members during the expansion process, if it is not desired for one or both of the members to remain expanded after the expansion force is removed. For example, the snap ring 52 is expanded during the expansion process in the method 10, without plastic deformation of the snap ring. However, since greater outward elastic deformation is produced in the snap ring 52 than in the housing 24 during the expansion process, the clearance between the snap ring and the housing increases when the expansion force is removed, as the snap ring returns to its initial unexpanded configuration.

Figure 6:
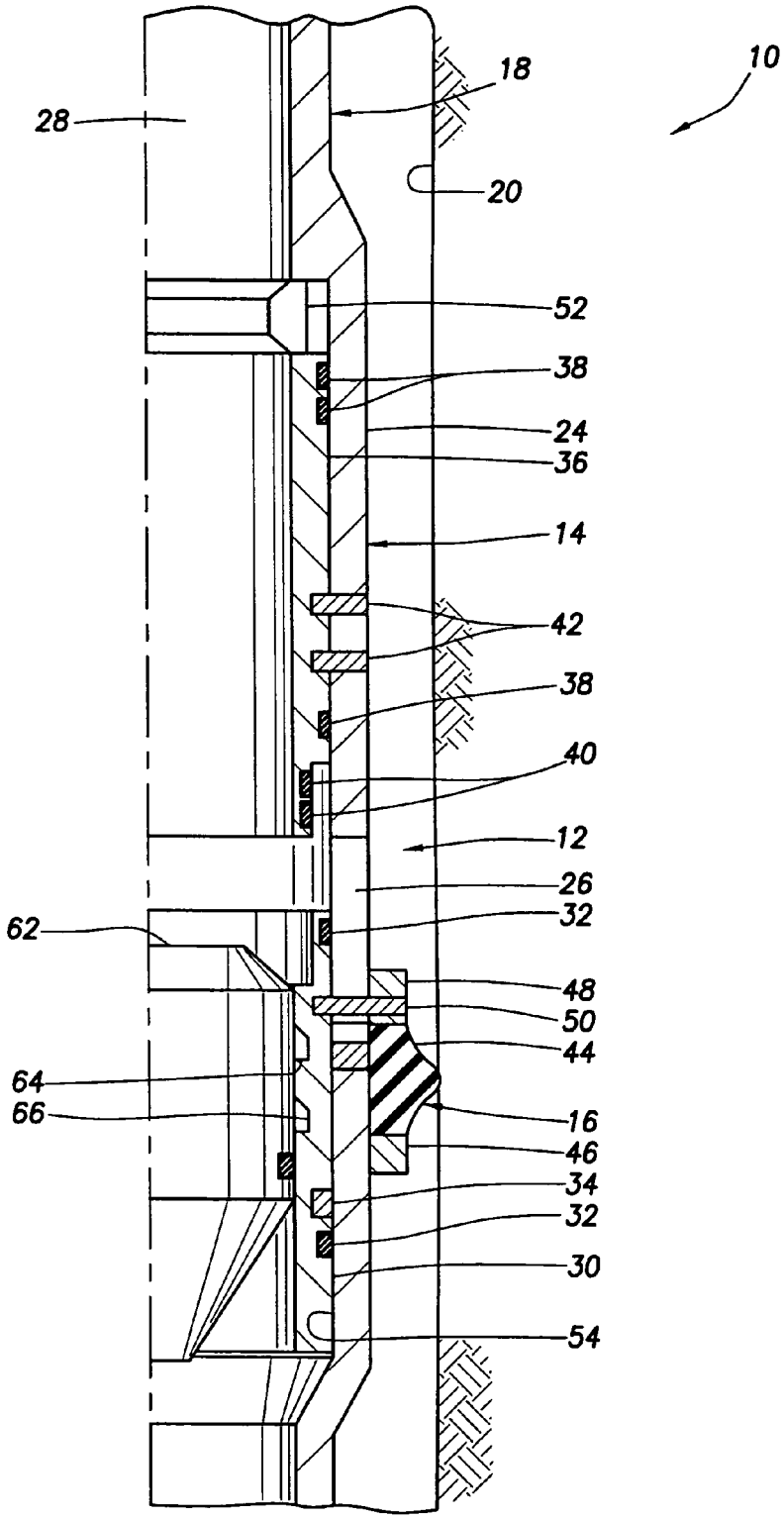
FIG. 6 is a cross-sectional view of the cementing tool, wherein a packer thereof has been set in a wellbore and a cementing port has been opened.

Referring additionally now to FIG. 6, the manner in which providing clearance between expanded members using the principles of the present invention enables operation of a well tool after expansion is representatively illustrated. As depicted in FIG. 6, a plug 62 has been lowered through the enlarged flow passage 28. A relatively large cone-shaped lower end 72 on the plug 62 permits the plug to pass through the snap ring 52. Keys or dogs 64 carried on the plug 62 engage an internal latching profile 66 on the opening sleeve 30, so that the plug is prevented from displacing further downward relative to the sleeve.

Pressure is increased in the flow passage 28 above the plug 62, such as by using a pump at the earth's surface, so that the plug biases the opening sleeve 30 in a downward direction due to the engagement of the keys 64 in the profile 66. When a pressure differential across the plug 62 and opening sleeve 30 is sufficiently great, the shear pin 34 shears, permitting the sleeve to displace downward along with the plug.

As described above, the opening sleeve 30 is attached to the packer sleeve 48 via the pin 50. Thus, the packer sleeve 48 also displaces downward with the opening sleeve 30. This downward displacement of the packer sleeve 48 longitudinally compresses the seal 44 between the packer sleeve and the ring 46.

Such longitudinal compression of the seal 44 causes it to extend radially outward and sealingly engage the wellbore 20. If the wellbore 20 were cased or otherwise lined, then the wellbore would be the interior of the casing or other lining, and the interior of the casing or other lining would be sealingly engaged by the seal 44.

Downward displacement of the opening sleeve 30 opens the port 26 to flow therethrough. At this point, a fluid, slurry, gel, etc. may be flowed between the interior of the string 18 and the wellbore 20 external to the string. For example, cement may be pumped through the flow passage 28, out the port 26, and into the wellbore 20 surrounding the string 18 to cement the string in the wellbore. As used herein, the terms "cement" and "cementing" are used to indicate the material and process, respectively, by which a tubular string is secured in a wellbore, the material at least partially hardening or solidifying in the space between the string and the wellbore. Any type of material may be used, such as cementitious material, epoxies, other polymers, etc.

Figure 7:
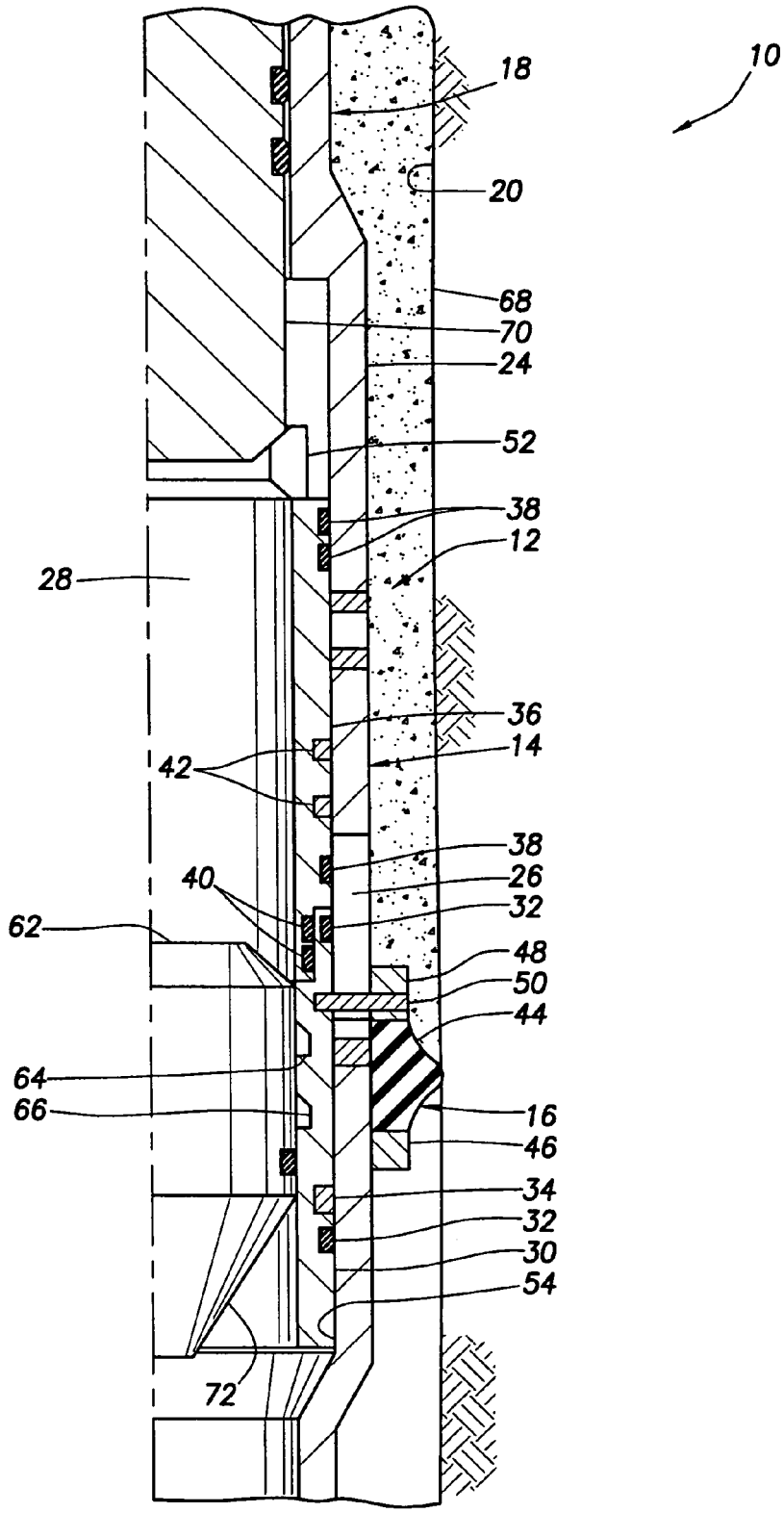
FIG. 7 is a cross-sectional view of the cementing tool, wherein the cementing port has been closed.

Referring additionally now to FIG. 7, the method 10 is representatively illustrated after cement 68 has been flowed through the port 26 into the wellbore 20 about the casing string 18. To close the port 26, another plug 70 is lowered through the casing string into the cementing tool 12. A lower end of the plug 70 engages the snap ring 52.

By increasing pressure in the casing string 18 above the plug 70, a pressure differential is created across the plug, biasing the plug downward. This downward biasing of the plug 70 is transmitted via the snap ring 52 to the closing sleeve 36. When the pressure differential is sufficiently great, the shear pins 42 shear, permitting the closing sleeve 36 to displace downwardly.

Downward displacement of the closing sleeve 36 closes the port 26 to flow therethrough. The seals 40 again sealingly engage the opening sleeve 30 where the sleeves overlap, preventing leakage therebetween. The plugs 62, 70 may now be retrieved or drilled through to permit access through the flow passage 28.

At this point, the casing string 18 above the cementing tool 12 is cemented in the wellbore 20. Further cementing operations may be performed in the casing string 18, as with conventional staged cementing operations.

Of course, a person skilled in the art would, upon a careful consideration of the above description of a representative example of the principles of the invention, readily appreciate that many modifications, additions, substitutions, deletions, and other changes may be made to this specific example, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method of expanding a well tool in a wellbore, the method comprising the steps of:

expanding first and second members of the well tool in the wellbore; and then operating the well tool by relative displacement between the first and second members, the well tool operating step including selectively opening a port in the well tool, thereby permitting flow through the port.

2. The method according to claim 1, wherein in the expanding step, the first member at least partially overlies the second member.

3. The method according to claim 1, wherein the expanding step further comprises transmitting at least a portion of an outwardly directed expansion force between the first and second members.

4. The method according to claim 1, wherein the expanding step further comprises radially outwardly deforming each of the first and second members.

5. The method according to claim 4 wherein in the deforming step, the first and second members directly contact each other.

6. The method according to claim 5, further comprising the step of removing an outwardly directed expansion force, thereby permitting the first and second members to at least partially retract and producing a clearance between the first and second members.

7. The method according to claim 6, wherein the force removing step is performed before the tool operating step.

8. The method according to claim 1, wherein the tool operating step further comprises selectively closing the port in the well tool, thereby blocking flow through the port.

9. The method according to claim 1, wherein the tool operating step further comprises outwardly extending a seal carried on the well tool.

10. The method according to claim 1, wherein in the expanding step, the second member has greater outward elastic deformation than the first member.

11. The method according to claim 1, wherein the expanding step further comprises enlarging a flow passage formed through the well tool.

12. The method according to claim 1, wherein the expanding step further comprises circumferentially elongating each of the first and second members.

13. The method according to claim 1, wherein the operating step further comprises displacing the second member longitudinally within the first member.

14. The method according to claim 1, wherein in the expanding step, the first and second members are in direct contact, and wherein in the tool operating step, clearance exists between the first and second members.

15. The method according to claim 1, wherein each of the first and second members is generally tubular shaped in the expanding step.

16. The method according to claim 1, further comprising the step of producing a clearance between the first and second members.

17. The method according to claim 16, wherein the clearance producing step is performed after the expanding step.

18. The method according to claim 16, wherein the clearance producing step is performed before the well tool operating step.

19. A well tool expandable in a wellbore, the well tool comprising:

first and second members, the second member being configured to have greater outward elastic deformation than the first member during expansion of the members; and the well tool being operable by relative displacement between the first and second members after the members are expanded, the well tool further comprising a port, and wherein relative displacement between the first and second members selectively opens and closes the port.

20. The well tool according to claim 19, wherein the first and second members are configured to be in direct contact during expansion of the members.

21. The well tool according to claim 20, wherein a clearance exists between the first and second members after the members are expanded.

22. The well tool according to claim 19, wherein at least one of the first and second members is circumferentially elongated during expansion of the members.

23. The well tool according to claim 19, wherein a flow passage extending through the well tool is enlarged when the first and second members are expanded.

24. The well tool according to claim 19, wherein each of the first and second members is generally tubular shaped.

25. The well tool according to claim 19, further comprising a seal, and wherein relative displacement between the first and second members outwardly extends the seal.

26. A system for expanding a well tool in a wellbore, the system comprising:

the well tool positioned in the wellbore, the well tool including first and second members;

an expander expanding the well tool in the wellbore; and the well tool further including a valve expanded outward by the expander, the valve being operated after expansion, and the well tool being configured so that the valve is operable after expansion by relative displacement between the first and second members.

27. The system according to claim 26, wherein the well tool is interconnected in a tubular string in the wellbore.

28. The system according to claim 27, wherein the expander displaces through the tubular string to expand the well tool.

29. The system according to claim 27, wherein the expander expands the tubular string in the wellbore.

30. The system according to claim 26, wherein the expander is a wedge.

31. The system according to claim 26, wherein the first and second members are configured so that the second member has greater outward elastic deformation than the first member when the expander expands the well tool.

32. The system according to claim 26, wherein the first member at least partially overlaps the second member when the expander expands the well tool.

33. The system according to claim 26, wherein the second member transmits an expansion force to the first member when the expander expands the well tool.

34. The system according to claim 26, wherein the first and second members are in direct contact when the expander expands the well tool.

35. The system according to claim 26, wherein a clearance is produced between the first and second members after the expander expands the well tool.

36. The system according to claim 26, wherein the second member retracts inward a greater distance than the first member after the expander expands the well tool, thereby producing a clearance between the first and second members.

37. The system according to claim 26, wherein the well tool includes a packer having a longitudinal flow passage therethrough expanded outward by the expander, the packer being operated after expansion.

38. A method of expanding a well tool in a wellbore, the method comprising the steps of:

providing the well tool having a first member at least partially overlying a second member;

expanding the well tool by applying an expansion force to the second member, thereby displacing the first and second members outward; and then operating the well tool by relative displacement between the first and second members, the well tool operating step including selectively closing a port in the well tool, thereby blocking flow through the port.

39. The method according to claim 38, wherein in the providing step, each of the first and second members is generally tubular shaped.

40. The method according to claim 38, wherein the expanding step further comprises transmitting at least a portion of the force between the first and second members.

41. The method according to claim 38, wherein the expanding step further comprises radially outwardly deforming each of the first and second members.

42. The method according to claim 41, wherein in the deforming step, the first and second members directly contact each other.

43. The method according to claim 42, further comprising the step of removing the expansion force, thereby permitting the first and second members to at least partially retract and producing a clearance between the first and second members.

44. The method according to claim 43, wherein the force removing step is performed before the tool operating step.

45. The method according to claim 38, wherein the tool operating step further comprises selectively opening the port in the well tool, thereby permitting flow through the port.

46. The method according to claim 38, wherein the tool operating step further comprises outwardly extending a seal carried on the well tool.

47. The method according to claim 38, wherein in the expanding step, the second member has greater outward elastic deformation than the first member.

48. The method according to claim 38, wherein the expanding step further comprises enlarging a flow passage formed through the well tool.

49. The method according to claim 38, wherein the expanding step further comprises circumferentially elongating each of the first and second members.

50. The method according to claim 38, wherein in the operating step, the relative displacement is in a direction orthogonal to the expansion force.

51. The method according to claim 38, wherein in the expanding step, the first and second members are in direct contact, and wherein in the tool operating step, clearance exists between the first and second members.

52. The method according to claim 38, further comprising the step of inwardly retracting the first and second members after the expanding step, the second member retracting inward a greater distance than the first member.

53. A method of expanding a valve in a wellbore, the method comprising the steps of:

interconnecting the valve in a tubular string, the valve selectively permitting and preventing flow through a port of the valve;

expanding the valve in the wellbore, the expanding step including radially outwardly deforming a tubular housing of the valve, the deforming step including radially outwardly deforming a sleeve of the valve, the sleeve contacting and outwardly biasing the housing; and then operating the valve.

54. The method according to claim 53, wherein the expanding step further comprises enlarging a flow passage formed through the valve.

55. The method according to claim 53, wherein the operating step further comprises displacing the sleeve relative to the housing.

56. The method according to claim 53, wherein the deforming step further comprises applying an expansion force to the sleeve.

57. The method according to claim 53, further comprising the step of permitting the housing and sleeve to retract after the expanding step, thereby producing a clearance between the sleeve and the housing.

58. The method according to claim 53, wherein in the expanding step, the sleeve has greater outward elastic deformation than the housing.

59. The method according to claim 53, further comprising the step of flowing fluid through the port after the operating step.

60. A system for expanding a well tool in a wellbore, the system comprising:

the well tool positioned in the wellbore, the well tool including first and second members;

an expander expanding the well tool in the wellbore; and the well tool further including a packer having a longitudinal flow passage therethrough expanded outward by the expander, the packer being operated after expansion, and the well tool being configured so that the packer is operable after expansion by relative displacement between the first and second members.

61. The system according to claim 60, wherein the well tool is interconnected in a tubular string in the wellbore.

62. The system according to claim 61, wherein the expander displaces through the tubular string to expand the well tool.

63. The system according to claim 61, wherein the expander expands the tubular string in the wellbore.

64. The system according to claim 60, wherein the expander is a wedge.

65. The system according to claim 60, wherein the first and second members are configured so that the second member has greater outward elastic deformation than the first member when the expander expands the well tool.

66. The system according to claim 60, wherein the first member at least partially overlaps the second member when the expander expands the well tool.

67. The system according to claim 60, wherein the second member transmits an expansion force to the first member when the expander expands the well tool.

68. The system according to claim 60, wherein the first and second members are in direct contact when the expander expands the well tool.

69. The system according to claim 60, wherein a clearance is produced between the first and second members after the expander expands the well tool.

70. The system according to claim 60, wherein the second member retracts inward a greater distance than the first member after the expander expands the well tool, thereby producing a clearance between the first and second members.

71. The system according to claim 60, wherein the well tool includes a valve expanded outward by the expander, the valve being operated after expansion.

* * * * *